US006177239B1

(12) United States Patent
Wang et al.

(10) Patent No.: US 6,177,239 B1
(45) Date of Patent: Jan. 23, 2001

(54) IMAGING ELEMENT

(75) Inventors: Yongcai Wang, Penfield; Janglin Chen; Dwight W. Schwark, both of Rochester, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/221,883

(22) Filed: Dec. 28, 1998

(51) Int. Cl.[7] ..... G03C 1/815; G03C 1/835; G03C 1/89; G03C 1/76

(52) U.S. Cl. ..... 430/512; 430/510; 430/517; 430/523; 430/527; 430/531; 430/533; 430/536; 430/961; 430/950

(58) Field of Search ..... 430/523, 527–531, 430/533, 536, 950, 961, 510, 512, 517

(56) References Cited

U.S. PATENT DOCUMENTS

| | | | |
|---|---|---|---|
| 3,121,060 | 2/1964 | Duane | 252/56 |
| 3,489,567 | 1/1970 | McGraw . | |
| 4,203,769 | 5/1980 | Guestaux | 430/631 |
| 4,612,279 | 9/1986 | Steklenski et al. | 430/536 |
| 4,735,976 | 4/1988 | Steklenski et al. | 524/32 |
| 4,766,059 | 8/1988 | Vandenabeele et al. | 430/523 |
| 5,204,233 | 4/1993 | Ogasawara et al. . | |
| 5,541,048 | 7/1996 | Whitesides et al. . | |
| 5,695,919 | 12/1997 | Wang et al. | 430/536 |

FOREIGN PATENT DOCUMENTS

| | | |
|---|---|---|
| 0080225 | 6/1983 | (EP) . |
| 0886176 | 12/1998 | (EP) . |

*Primary Examiner*—Richard L. Schilling
(74) *Attorney, Agent, or Firm*—Doreen M. Wells; Carl F. Ruoff

(57) ABSTRACT

The present invention is an imaging element which includes a support, an image forming layer superposed on the support and at least one layer superposed on the support. The at least one layer is formed from a non-aqueous coating composition composed of a composite wax particle having a wax phase and a non-crosslinked polymer phase. The wax phase includes a wax having a melting point of greater than 30° C., the wax comprising greater than 80% by weight of the wax phase. The at least one layer has a dry coating weight of from 1 to 300 mg/m$^2$.

11 Claims, No Drawings

IMAGING ELEMENT

CROSS REFERENCE TO RELATED APPLICATIONS

This application relates to commonly assigned copending application Ser. No. 09/221,639, filed simultaneously herewith. This application relates to commonly assigned copending application Ser. No. 09/221,469, filed simultaneously herewith. This application relates to commonly assigned copending application Ser. No. 09/221,083, filed simultaneously herewith. This application relates to commonly assigned copending application Ser. No. 09/221,470,filed simultaneously herewith. This application relates to commonly assigned copending application Ser. No. 09/221,465, filed simultaneously herewith. This application relates to commonly assigned copending application Ser. No. 09/221, 776, filed simultaneously herewith. This application relates to commonly assigned copending application Ser. No. 09/221,516, filed simultaneously herewith. These copending applications are incorporated by reference herein.

FIELD OF THE INVENTION

This invention is related to an imaging element having a lubricant layer including a composite wax particle.

BACKGROUND OF THE INVENTION

The imaging elements to which this invention relates can be of many different types depending on the particular use for which they are intended. Such elements include, for example, photographic, electrophotographic, electrostatographic, photothermographic, migration, electrothermographic, dielectric recording, inkjet ink recording and thermal-dye-transfer imaging elements.

Layers of imaging elements other than the image-forming layer are commonly referred to auxiliary layers. There are many different types of auxiliary layers such as, for example, subbing layers, backing layers, interlayers, overcoat layers, receiving layers, stripping layers, antistatic layers, transparent magnetic layers, and the like.

Support materials for an imaging element often employ auxiliary layers comprising glassy, hydrophobic polymers such as polyacrylates, polymethacrylates, polystyrenes, or cellulose esters, for example. One typical application for such an auxiliary layer is as a backing layer to provide resistance to abrasion, scratching, blocking, and ferrotyping. Such backing layers may be applied directly onto the support material, applied onto a priming or "subbing" layer, or applied as an overcoat for an underlying layer such as an antistatic layer, transparent magnetic layer, or the like. For example, U.S. Pat. No. 4,203,769 describes a vanadium pentoxide-containing antistatic layer that is overcoated with a cellulosic layer applied from an organic solvent. U.S. Pat. Nos. 4,612,279 and 4,735,976 describe organic solvent-applied layers comprising a blend of cellulose nitrate and a copolymer containing acrylic acid or methacrylic acid that serve as overcoats for antistatic layers.

Frequently, when the auxiliary layer serves as the outermost layer, as is the case for a backing layer, it is desirable for this layer to have a low coefficient of friction (COF) to provide proper conveyance properties and to protect the imaging element from mechanical damage during the manufacturing process or customer use. It is known to protect imaging elements against mechanical damage by coating them with a layer comprising a lubricant such as a silicone fluid as described in U.S. Pat. No. 3,489,567, and a wax esters of high fatty acids or high fatty alcohols in U.S. Pat. No. 3,121,060. However, problems are encountered in the use of these lubricants. For example, when silicone is used as a lubricant for a backing layer, it may move to the surface of the support where an image element is to be coated. This will give an adverse effect (e.g. wetting) on the subsequent coating processes. They may also not survive processing so that the advantage of low surface friction is lost for the post-processed products. In addition, it has proven difficult to provide a single layer applied from organic medium that comprises both an abrasion-resistant polymer and a lubricant since it is difficult to find a coating medium that dissolves both the polymer and the lubricant and is at the same time attractive from an enviromental and health standpoint. It is also difficult to form a stable dispersion of a lubricant such as a wax in an organic medium that may be added to a coating composition containing a dissolved, abrasion-resistant polymer. Therefore, in order to form a layer which can be applied from liquid organic medium that is both abrasion-resistant and has a low coefficient of friction one often applies two separate layers; a first layer which is comprised of an abrasion-resistant polymer and then a second layer which is comprised of a lubricant such as a wax. The need to apply these two separate layers increases both manufacturing complexity and cost.

U.S. Pat. No. 4,766,059 describes a method of making solid spherical beads having a mean size ranging form 0.5 to about 20 microns. The polymer beads contain a polymeric resinous material and a water insoluble wax. The process of making such solid beads involves the use of water miscible or immiscible low boiling solvent to dissolve both polymeric materials and wax, and subsequently removal of the solvent or solvent mixture by evaporation. This requires large processing equipment and lengthy processing time, which increases the expenses. U.S. Pat. No. 5,695,919 describes a lubricant impregnated core/shell polymer particle, the polymer particle comprising a core portion which is insoluble in the organic medium and a shell portion which has an affinity for both the core portion and the organic medium.

Therefore, a foremost objective of the present invention is to provide an imaging element with a new lubricant layer composition which survives photographic material processing, does not transfer to the surface of the support to which the imaging layer to be coated, and can be applied from a low hazard organic solvent or solvent mixture.

SUMMARY OF THE INVENTION

The present invention is an imaging element which includes a support, an image forming layer superposed on the support and at least one layer superposed on the support. The at least one layer is formed from a non-aqueous coating composition composed of a composite wax particle having a wax phase and a non-crosslinked polymer phase. The wax phase includes a wax having a melting point of greater than 30° C., the wax comprising greater than 80% by weight of the wax phase. The at least one layer has a dry coating weight of from 1 to 300 mg/m$^2$.

DETAILED DESCRIPTION OF THE INVENTION

In accordance with the presence invention, the lubricant layer is formed from a nonaqueous coating composition and contains more than 80% of a composite wax particle having a wax phase and a non-crosslinked polymer phase. The wax phase comprises greater than 80% by weight of a wax having a melting point of greater than 30° C. The total coating weight in the lubricant layer is in the range of from 1 to 300 mg/m$^2$ and preferably from 5 to 150 mg/m$^2$. In principle, the upper value of the composite wax particle is limited by both the physical appearances and friction values of the lubricant layer. For example, if the coverage is too high, a hazy looking surface will appear, which therefore can have an effect on the sensitometric properties of the imaging element. The lower limiting value is set by the requirement on the surface friction value of the lubricant layer, which is determined by both manufacturing processes and applications of the imaging element.

A preferred imaging element according to the present invention comprises one or more imaging layers on one side of the support and the lubricant layer present on the other side of the support as an outermost backing layer, or as an outermost layer coated on the top of an abrasion resistance backing layer, or as an outermost layer coated on the top of an antistatic layer, or as an outermost layer coated on an magnetic recording layer. The lubricant layer can contain additives such as coating aids, charge control surfactants, matting agents, and crosslinkers.

According to a first embodiment said composite wax particles are coated from a solvent on a support surface which is unsubbed or subbed with an adhesion promotion layer (primer layer). The unsubbed support surface can be pre-modified with treatment such as, for example, corona discharge, plasma, solvent itching, and the like. The support surface can also employ an undercoat or subbing layer well-known in the art that comprises, for example, for polyester support a vinylidene chloride/methyl acrylate/itaconic acid terpolymer or vinylidene chloride/acrylonitrile/acrylic acid terpolymer.

According to a second embodiment the composite wax particles are coated from a solvent on a support which employs an abrasion resistance backing layer that comprises, for example, an acrylic polymer, a cellulose derivative, a polyurethane, a mixture of film-forming and non-film forming polymer particles, a sol-gel material, and the like. Such abrasion resistance layer composition has been described in, for example, U.S. Pat. Nos. 4,582.784, 5,045,394, 5,232,824, and 5,447,832.

According to a third embodiment said composite wax particles are coated from a solvent on a support which contains an antistatic layer that comprises, for example, a highly crosslinked vinylbenzyl quaternary ammonium polymer and a hydrophobic binder described in U.S. Pat. No. 4,070,189, a highly conductive colloidal vanadium pentoxide described in U.S. Pat. Nos. 4,203,769, and 5,006,451, a conductive fine particle of crystalline metal oxides and a film-forming binder, an conductive metal antimonate and a film-forming binder described in U.S. Pat. No. 5,368,995, and the like.

According to a fourth embodiment said composite wax particles are coated from a solvent on a support which contains a magnetic recording layer as described in, for example, U.S. Patent No. Research Disclosure, November, 1992, Item 34390, and U.S. Pat. Nos. 5,395,743, 5,397,826, 5,113,903, 5,432,050, 5,434,037, and 5,436,120.

As the organic solvent, any of the members customarily used in coating compositions may be satisfactorily used. However, the preferred solvents for the practice of the present invention may include, for example, acetone, methyl ethyl ketone, methanol, ethanol, butanol, dowanol PM, iso-propanol, propanol, toluene, xylene, methyl isobutyl ketone, methylene chloride, and their mixtures.

The composite wax particles of the present invention have a wax phase composed of greater than 80% by weight of a wax having a melting point of greater than 30° C. and a non-crosslinked polymer phase, and preferably a mean size smaller than 1 micron. Wax useful for the practice of the invention has been described, for example, in references such as "The Chemistry and Technology of Waxes", A. H. Warth, 2$^{nd}$ Ed., Reinhold Publishing Corporation, New York, N.Y. 1956, and "Plastics Additives and Modifiers Handbook", Chapter 54–59, J. Ederibaum (Ed.), Van Nostrand Reinhold, New York, N.Y. 1992. Suitable waxes include hydrocarbon and/or ester-containing waxes, e.g. animal waxes such as beewax, plant waxes such as carnauba wax, paraffin waxes, microcrystalline waxes, Fischer-Torpsch waxes, polyethylene waxes, polypropylene waxes, and a mixture thereof.

The composite wax particle of the present invention is preferably prepared by polymerizing a vinyl monomer or a monomer mixture in the presence of pre-formed aqueous wax particles. Pre-formed aqueous wax dispersion (or emulsion) is primarily composed of wax particles, dispersants/surfactants, and water. The dispersants can be nonionic, anionic, and cationic, and can be polymeric and are used at levels as high as 20% of the wax. Wax particles can be formed by various methods known in the art. For example, they can be prepared by pulverizing and classifying dry waxes or by spray drying of a solution containing waxes followed by redipsersing the resultant particles in water using a dispersant; They can be prepared by a suspension technique which consists of dissolving a wax in, for example, a water immiscible solvent, dispersing the solution as fine liquid droplets in an aqueous solution, and removing the solvent by evaporation or other suitable techniques; They can be prepared by mechanically grinding a wax material in water to a desired particle size in the presence a dispersant, heating the wax particles dispersed in water to above their melting point, and cooling the melted particles in water to form a stable wax emulsion.

In the present invention, the pre-formed aqueous wax dispersions are formed by the so-called "atmospheric emulsification" and "pressure emulsification" techniques. The atmospheric process is used to prepare wax dispersions for waxes with melting points below the boiling point of water. The process typically consists of melting wax and surfactant together, and optionally a base is added to the melt. Hot water is then slowly added to the wax melt at vigorous agitation (water to wax). Wax emulsion can also be formed by adding molten wax/surfactant blend to boiling water at vigorous agitation. Pressure emulsification is generally needed for wax with m.p. greater than 100° C. It is similar to the process described above except at temperatures above the water boiling point. Vessels capable of withstanding high pressures are normally used.

Ethylenically unsaturated monomers which may be used to prepare the polymer phase of the composite wax particles of the present invention may include acrylic monomers, such as acrylic acid, or methacrylic acid, and their alkyl esters such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, and the nitriles and amides of the same acids such as acrylonitrile, methacrylonitrile, acrylamide and methacrylamide. Other monomers which may be used, either alone or in admixture with these acrylic monomers, include vinyl acetate, poly(ethylene glycol) (meth)acrylates, N-vinyl-2-pyrrolidone, vinylimidazole vinyl propionate, vinylidene chloride, vinyl chloride, and vinyl aromatic compounds such as styrene, t-butyl styrene and vinyl toluene. Other comonomers which may be used in conjunction with any of the foregoing monomers include dialkyl maleates, dialkyl itaconates, dialkyl methylene malonates, isoprene, and butadiene. The polymerization reaction involved in the present invention is initiated and maintained with an initiating agent or catalyst, which is very similar to those used in conventional emulsion polymerization. Most useful catalysts for the practice of the present invention are azo, diazo, and peroxide compounds, for example, benzoyl peroxide, azobisisobytyronitrile and azobiscyanovaleric acid. The amount of the initiators employed follows generally the practice in conventional emulsion polymerization. In general, the amounts can vary within the range of about 0.2 to 3 or 4 weight percent or possibly higher by weight of the total monomers. It is generally recognized that higher levels of initiators tend to result in lowered molecular weights for the ultimate polymers. If the polymerization is carried out in multiple stages, the amount of initiators in the beginning or initiating stage is adjusted to match the proportion of the monomer then present, and further initiators are fed during the delayed feed stage to correspond to the delayed feed of the monomers. Basically, in any case, the initiators are supplied as needed to maintain the reaction in smooth and easily controlled conditions. Surfactants that can be used in the present invention include, for example, a sulfate, a sulfonate, a cationic compound, an amphoteric compound, and a polymeric protective colloid. Specific examples are described in "McCUTCHEON'S Volume 1: Emulsifiers & Detergents, 1995, North American Edition". Chain transfer agents may also be used to control the properties of the polymer particles formed.

Generally speaking, the reaction conditions employed in the execution of the present method parallels those utilized in conventional emulsion polymerization as regards such variables as temperature, time, agitation, equipment, etc. The reaction temperature can be maintained at a constant value or can vary from 50 to 80 or 90° C. If the reaction temperature varies, the starting temperature is usually around 50 to 55° C., and as the reaction proceeds exothermically, the temperature rises.

The time of the reaction is difficult to predict since it will depend upon other variables, such as the amount of initiating agent introduced, the reaction temperature, etc. If the amount of monomer is small, the reaction may be finished within about an hour but with larger amounts the reaction will usually continue for 3 to 4 hours. Post-heating stages after all monomer has been added can be used to insure that the polymerization has gone to completion and no free monomer is present. The sequence of addition of the various ingredients is not critical and can be varied. Usually, aqueous medium is first added to the reactor, then aqueous wax dispersion, and monomer in that order, all being added while the medium is thoroughly agitated, followed by the initiators, but other sequences are possible.

In one of the preferred embodiments of the invention, the involves polymerization process in the presence of preformed aqueous wax particles is carried out sequentially (see, for example, Padget, J. C. in Journal of Coating Technology, Vol 66, No. 839, pages 89 to 105, 1994). In this process, the polymerization is conducted in a monomer-starved manner.

The copolymer contained in the composite wax particles of the invention is properly designed to have good "bonding" with the wax phase and good compatibility in the solvent medium. Defining compatibility of the copolymer in the solvent medium can be achieved by using the concept of "polymer solubility map" (see, for example, Ramsbothan, J. in Progress in Organic Coatings, Vol 8, pages 113–141, 1980; and Wicks, Jr. Z. W., Jones, F. N., and Papas, S. P. in Organic Coatings, pages 229–239, 1992, John Wiley & Sons, Inc.). As the organic Solvents, any of the organic solvents customarily used in coating compositions may be satisfactorily used.

Since the polymer contained in the composite wax particle of the invention must be soluble in the non-aqueous medium it is necessary that the polymer is firmly bound either physically or chemically to the wax phase. Otherwise the polymer may be dissolved away from the wax phase and the composite wax particles would lose its stability. Chemical bonding can be achieved by grafting of the polymer to the wax phase. One of the mechanisms may involve abstraction of hydrogen from the wax molecule by free radical present in the system, giving active centers onto which the polymer chain may grow.

Although the polymer phase consisting of non-crosslinked polymers, the polymers may carry in addition to the polymerizable group a chemically functional group wherein the non-crosslinked polymers are rendered crosslinkable by an external crosslinking agent and can be crosslinked after the application to s substrate of a coating composition into which the composite wax particles are incorporated.

The composite wax particles of the invention may be incorporated directly into a coating composition. Alternatively, the composite wax particles may be first isolated from the aqueous dispersion, for example, by spray drying, and then be incorporated into a liquid coating composition as a dry powder.

The imaging elements of this invention can be of many different types depending on the particular use for which they are intended. Details with respect to the composition and function of a wide variety of different imaging elements are provided in U.S. Pat. No. 5,300,676 and references described therein. Such elements include, for example, photographic, electrophotographic, electrostatographic, photothermographic, migration, electrothermographic, dielectric recording and themal-dye-transfer imaging elements. Layers of imaging elements other than the image-forming layer are commonly referred to auxiliary layers. There are many different types of auxiliary layers such as, for example, subbing layers, backing layers, interlayers, overcoat layers, receiving layers, stripping layers, antistatic layers, transparent magnetic layers, and the like.

Support materials for an imaging element often employ auxiliary layers comprising glassy, hydrophobic polymers such as polyacrylates, polymethacrylates, polystyrenes, or cellulose esters, for example. One typical application for such an auxiliary layer is as a backing layer to provide resistance to abrasion, scratching, blocking, and ferrotyping. Such backing layers may be applied directly onto the support material, applied onto a priming or "subbing" layer, or applied as an overcoat for an underlying layer such as an antistatic layer, transparent magnetic layer, or the like. For example, U.S. Pat. No. 4,203,769 describes a vanadium pentoxide-containing antistatic layer that is overcoated with a cellulosic layer applied from an organic solvent. U.S. Pat. Nos. 4,612,279 and 4,735,976 describe organic solvent-applied layers comprising a blend of cellulose nitrate and a copolymer containing acrylic acid or methacrylic acid that serve as overcoats for antistatic layers.

In a particularly preferred embodiment, the imaging elements of this invention are photographic elements, such as photographic films, photographic papers or photographic glass plates, in which the image-forming layer is a radiation-sensitive silver halide emulsion layer. The thickness of the support is not crtitical. Support thickness of 2 to 10 mil (0.06 to 0.30 millimeters) can be used. The supports typically employ an undercoat or subbing layer well known in the art that comprises, for example, for polyester support a vinylidene chloride/methyl acrylate/itaconic acid terpolymer or vinylidene chloride/acrylonitrile/acrylic acid terpolymer. The emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention an contain auxiliary layers conventional in photographic elements, such as vercoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in Research Disclosure, Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in Research Disclosure, Item 36544, September, 1994, and the references listed therein.

The photographic silver halide emulsions utilized in this invention can contain other addenda conventional in the photographic art. Useful addenda are described, for example, in Research Disclosure, Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the hotographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The following examples are used to illustrate the present invention. However, it should be understood that the invention is not limited to these illustrative examples.

EXAMPLES

Example 1

The following wax impregnated polymer particle was prepared according to the process as described in U.S. Pat. No. 5,695,919. A stirred reactor containing 382.5 g of deionized water, 27.0 g of 10% by weight Rhone Poulenc Rhodapex CO-436 surfactant, and 240.0 g of Michemlube 160 aqueous carnauba wax dispersion (ML160, 25% solids, from Michelman Inc.) was heated to 80 deg. C. and purged with $N_2$ for 1 hour. After addition of 0.5 g of potassium persulfate, an emulsion containing 102.8 g of deionized water, 84.0 g of isobutyl methacrylate, 30.0 g of styrene, 27.0 g of 10% by weight Rhone Poulenc Rhodapex CO-436 surfactant and 0.25 g of potassium persulfate was slowly added over a period of 1 hour. The reaction was allowed to continue for an additional 2 hours. 0.35 g of benzoyl peroxide in 5 g of toluene was then added to reactor. An emulsion containing 444.0 g of deionized water, 36.0 g of 10% by weight Rhone Poulenc Rhodapex CO-436 surfactant, 96.0 g of isobutyl methacrylate, 24.0 g of methacrylic acid, and 0.15 g of benzoyl peroxide was added continuously for 1 hour. The reaction was allowed to continue for 3 more hours before the reactor was cooled down to room temperature. The latex prepared was filtered through glass fibre to remove any coagulum. The latex so made was mixed with acetone at 1:1 ratio to isolate the polymer particles. The precipitate was washed several times with distilled water to remove any residual surfactants and salts. Final drying was in an oven heated to 50 deg. C. The particles prepared contained about 60% by weight core portion and 40% by weight shell portion and the wax content was 20% by weight of the polymer particles. The core portion polymer composition was 70% by weight isobutyl methacrylate and 30% by weight styrene. The shell portion polymer composition was 80% by weight isobutyl methacrylate and 20% by weight methacrylic acid. The polymer particle is designated as Com-1.

Example 2

Preparation of Composite Wax Particle of the Invention

A stirred reactor containing 438.3 g of Michemlube 160 (25% solids, from Michelman, Inc.) was heated to 85 deg. C. and purged with $N_2$ for 2 hour. 0.365 g of azobisisobutyronitrile in 10 g of toluene was then added to the reactor. An emulsion containing 109.6 g of deionized water, 32.9 g of 10% by weight Triton X100 surfactant, 9.1 g of a 10% by weight sodium dodecyl sulfonate surfactant, 87.7 g of methyl methacrylate, 21.9 g of vinyl pyrrolidone, and 0.18 g of azobisisobutyronitrile was added continuously for 2 hours. The reaction was allowed to continue for 4 more hours before the reactor was cooled down to room temperature. The composite wax particle dispersion prepared was filtered through glass fiber to remove any coagulum.

The resultant composite wax particle dispersion has a solid of about 31%. The particle contains about more than 40% by weight of carnauba wax, about 50% by weight of poly(methyl methacrylate-co-vinyl pyrrolidone) (MMA/VP 80/20) with the balance being the amount of stabilizers/dispersants used. The composite wax particle is designated as Wax-1.

Composite wax particles Wax-2 to Wax-16 were prepared in a similar manner. Their compositions and other parameters are listed in Table 1.

TABLE 1

| Particle Designation | Wax Particle | Copolymer Composition | Wax/ Polymer |
|---|---|---|---|
| Wax-1 | ML160 (130 nm) From Michelman, Inc. | Poly(methyl methacrylate-co-vinyl pyrrolidone) 80/20 | 50/50 |
| Wax-2 | ML160 (130 nm) From Michelman, Inc | Poly(methyl methacrylate-co-vinyl pyrrolidone) 60/40 | 50/50 |
| Wax-3 | ML160 (130 nm) From Michelman, Inc | Poly(methyl methacrylate-co-vinyl pyrrolidone) 90/10 | 50/50 |
| Wax-4 | ML160 (130 nm) From Michelman, Inc | Poly(methyl methacrylate-co-vinyl pyrrolidone) 95/5 | 50/50 |
| Wax-5 | ML160 (130 nm) From Michelman, Inc | Poly(methyl methacrylate-co-hydroxyethyl methacrylate) 97.5/12.5 | 50/50 |
| Wax-6 | ML160 (130 nm) From Michelman, Inc | Poly(methyl methacrylate-co-N,N-dimethyl acrylamide) 90/10 | 50/50 |
| Wax-7 | ML160 (130 nm) From Michelman, Inc | Poly(methyl methacrylate-co-2-vinylpyridine) 90/10 | 50/50 |
| Wax-8 | ML160 (130 nm) From Michelman, Inc | Poly(methyl methacrylate-co-poly(ethylene glycol) methacrylate Mn = 360) 95/15 | 50/50 |
| Wax-9 | ML160 (130 nm) From Michelman, Inc | Poly(methyl methacrylate-co-methacrylic acid) 85/15 | 50/50 |
| Wax-10 | ML160 (130 nm) From Michelman, Inc | Poly(ethyl methacrylate-co-methacrylic acid) 85/15 | 50/50 |
| Wax-11 | ML160 (130 nm) From Michelman, Inc | Poly(butyl methacrylate-co-methacrylic acid) 85/15 | 50/50 |
| Wax-12 | ME 48040 (300 nm) From Michelman | Poly(isobutyl methacrylate-co-methacrylic acid) 85/15 | 50/50 |
| Wax-13 | ME 48040 (300 nm) From Michelman | Poly(ethyl methacrylate-co-methacrylic acid) 85/15 | 50/50 |
| Wax-14 | ML160 (130 nm) From Michelman, Inc. | Poly(methyl methacrylate-co-vinylpyrrolidone) 80/20 | 65/35 |

Example 3

This example shows that coating compositions comprising the composite wax particles of the invention provide transparent films with excellent frictional characteristics (i.e., low coefficient of friction values) when incorporated at extremely low levels compared to those used in prior art. Surface lubricant layers were prepared from coating compositions consisting of Wax-1 to Wax-10, respectively, in an acetone/methanol solvent mixture. The coating compositions had excellent solution stability and gave transparent, dried surface lubricant layer when applied onto cellulose acetate substrate at a dry coverage of 50 mg/m$^2$. The coefficient of friction as measured by the method set forth in ANSI IT 9.4-1992 is about 0.1 or less.

A comparative surface layer was prepared by using Com-1 on cellulose acetate support. Com-1 was prepared according to the process as described in U.S. Pat. No. 5,695,919. It has to be coated at very high dry coverage to provide a surface layer with low coefficient of friction. In this Comparative example Com-1 was applied to have a dry coverage of about 800 mg/m$^2$. The coefficient of friction as measured by the method set forth in ANSI IT 9.4-1992 is about 0.15.

This example shows that the composite wax particles of this invention are superior to the lubricant impregnated polymer particles described in U.S. Pat No. 5,695,919, and capable of providing imaging elements with a coated layer with superior surface lubricity at extremely low dry coverage.

Example 4

Coating Solution Stability

Coating solutions containing various types of wax dispersions were prepared at room temperature in various organic solvents and solvent mixtures. The coating solutions have a solids content varying from 0.5 to 0.8 percent by weight. The coating solution stability was inspected visually right after preparation, after storage at room temperature for 24 hours and after storage at room temperature for a week, respectively. Coating solutions in the Comparative solution samples were prepared as in U.S. Pat No. 5,798,136. The stability of the coating solutions prepared using wax particles disclosed in the prior art is very sensitive to the presence of coating addenda and to changes in solvent composition. The stability of the coating solutions prepared using the composite wax particles of the invention is excellent in many different solvent systems.

TABLE 2

Coating Solution Stability

| Coating Solution | Wax Particle | Solvent | Fluorinated Surfactant | Stability |
|---|---|---|---|---|
| Solution 1 (Comparative) | PE325N35* | Acetone/ Methanol 50/50 | FC431 0.02 wt % | Immediate Flocculation |
| Solution 2 (Comparative) | ME39235** | Acetone/ Methanol 50/50 | FC431 0.02 wt % | Immediate Flocculation |
| Solution 3 (Invention) | Wax-1 (Table 1) | Acetone/ Methanol 50/50 | FC431 0.02 wt % | Stable |
| Solution 4 (Invention) | Wax-6 (Table 1) | Acetone/ Methanol 50/50 | FC431 0.02 wt % | Stable |
| Solution 5 (Invention) | Wax-10 (Table 1) | Acetone/ Methanol 50/50 | FC431 0.02 wt % | Stable |
| Solution 6 (Comparative) | PE325N35 | Isobutyl alcohol/ Dichloro-methane 35/65 | No | Immediate Flocculation |
| Solution 7 (Comparative) | ME39235 | Isobutyl alcohol/ Dichloro-methane 35/65 | No | Immediate Flocculation |
| Solution 8 (Invention) | Wax-1 | Isobutyl alcohol/ Dichloro-methane 35/65 | No | Stable |
| Solution 9 (Invention) | Wax-9 | Isobutyl alcohol/ Dichloro-methane 35/65 | No | Stable |
| Solution 10 (Invention) | Wax-15 | Isobutyl alcohol/ Dichloro-methane 35/65 | No | Stable |
| Solution 11 (Invention) | Wax-15 | Isobutyl alcohol/ Dichloro-methane 35/65 | FC431 0.02 wt % | Stable |
| Solution 12 (Invention) | Wax-1 | Isobutyl alcohol/ Dichloro-methane 35/65 | FC431 0.02 wt % | Stable |
| Solution 13 (Invention) | Wax-10 (Table 1) | Isobutyl alcohol/ Dichloro-methane 35/65 | FC431 0.02 wt % | Stable |
| Solution 14 (Invention) | Wax-15 | Toluene | No | Stable |
| Solution 15 (Invention) | Wax-15 | Toluene/ Methanol 80/20 | FC431 0.02 wt % | Stable |
| Solution 16 (Invention) | Wax-16 | Toluene/ Methanol 80/20 | FC431 0.02 wt % | Stable |
| Solution 17 (Invention) | Wax-16 | MEK | No | Stable |

*From Chemical Corporation of America
**From Michelman, Inc.

The invention has been described in detail with particular reference to certain preferred embodiments thereof, but it will be understood that variations and modifications can be effected within the spirit and scope of the invention.

What is claimed is:

1. An imaging element comprising:

a support;

an image forming layer superposed on said support; and at least one layer superposed on said support formed from a non-aqueous coating composition comprising a composite wax particle consisting essentially of a wax phase comprising greater than 80% by weight of a wax having a melting point of greater than 30° C. and a non-crossliked polymer phase, said at least one layer having a dry coating weight of from 1 to 300 mg/m$^2$.

2. The imaging element of claim 1 wherein the support comprises polymeric films, papers, or glasses.

3. The imaging element of claim 1 wherein the wax particle comprises a mean size smaller than 1 micron.

4. The imaging element of claim 1 wherein the wax phase of the wax particle further comprises dispersants/surfactants or water.

5. The imaging element of claim 1 wherein the wax comprises animal waxes, plant waxes, paraffin waxes, microcrystalline waxes, Fischer-Torpsch waxes, polyethylene waxes or polypropylene waxes.

6. The imaging element of claim 1 wherein the non-crosslinked polymer phase is prepared from monomers comprising acrylic monomers, alkyl esters of acrylic monomers, hydroxyalkyl esters of acrylic acids, nitrites of acrlic acids, amides of acrylic acids, vinyl acetate, poly (ethylene glycol)(meth)acrylates, N-vinyl-2-pyrrolidone, vinytimidazole, vinyl propionate, vinylidene chloride, vinyl chloride, vinyl aromatic compounds, dialkyl maleates, dialkyl itaconates, dialkyl methylene malonates, isoprene or butadiene.

7. The imaging element of claim 1 wherein the nonagueous coating composition comprises an organic solvent comprises acetone, methyl ethyl ketone, methanol, ethanol, butanol, dowanol PM, iso-propanol, propanol, toluene, xylene, methyl isobutyl ketone or methylene chloride.

8. The imaging element of claim 1 wherein the at least one layer further comprises binders.

9. The imaging element of claim 8 wherein the binder comprise polyesters, polyamides, polyurethanes, cellulose derivatives, polyacrylates, polycarbonates, polyvinyl acetate, polyvinyl butyral, polyvinyl acetal, polystyrene, styrene-butadiene copolymers, epoxy resins, melamine resins, phenolic resins or vinylidene fluoride-containing polymers.

10. The imaging element of claim 1 wherein the at least one layer further comprises matting agents, surfactants, coating aids, inorganic fillers, conductive metal oxide particles, carbon black, magnetic particles, pigments, dyes, biocides, UV stabilizers or thermal stabilizers.

11. The imaging element of claim 1 wherein the imaging layer comprises a photographic emulsion layer.

* * * * *